US005105494A

United States Patent [19]

Ogg

[11] Patent Number: 5,105,494

[45] Date of Patent: Apr. 21, 1992

[54] CONTINUOUSLY MOVING HIGHWAY RECONSTRUCTION DEVICE

[75] Inventor: D. Cameron Ogg, Dallas, Tex.

[73] Assignee: Highway Construction Bridge Systems, Inc., Dallas, Tex.

[21] Appl. No.: 621,308

[22] Filed: Dec. 3, 1990

[51] Int. Cl.[5] ..... E01D 15/10; E01D 1/00

[52] U.S. Cl. ..... 14/78; 14/2.4; 404/1

[58] Field of Search ..... 14/1, 2.4, 72.5, 71.1, 14/71.3, 71.5, 71.7; 404/1

[56] References Cited

U.S. PATENT DOCUMENTS 2,363,767 11/1944 Yassin ..... 401/1 X
3,811,147 5/1974 Dix ..... 14/1
4,698,866 10/1987 Kano ..... 14/1

FOREIGN PATENT DOCUMENTS 3107408 11/1982 Fed. Rep. of Germany ..... 14/2.4
2187776 9/1987 United Kingdom ..... 14/2.4

*Primary Examiner*—Hoang C. Dang
*Attorney, Agent, or Firm*—Jones, Day, Reavis & Pogue

[57] ABSTRACT

The present invention relates to a road excavation and paving system having a main bridge section and ramp sections attached thereto for allowing traffic to continuously flow to and from the old highway and to and from the new highway. The old highway is reconstructed under the main bridge section. Crossovers are necessary to allow cross traffic over the old and new highways. The system has a plurality of movable pads connected by hydraulic pistons to the main bridge section for incrementally moving the system while the old road is being excavated and rebar is being laid on the new surface. After the rebar has been laid down, cement may be poured and the road finished to provide a continuous system for excavating and constructing the new highway. There is a continuous flow of traffic over the system while the old highway is being excavated and the new highway is being built. A unique feature of this invention is the capability of maintaining continuous traffic in both directions as well as providing for the necessary traffic lanes for service vehicles to carry materials to and remove materials from the main bridge section.

23 Claims, 13 Drawing Sheets

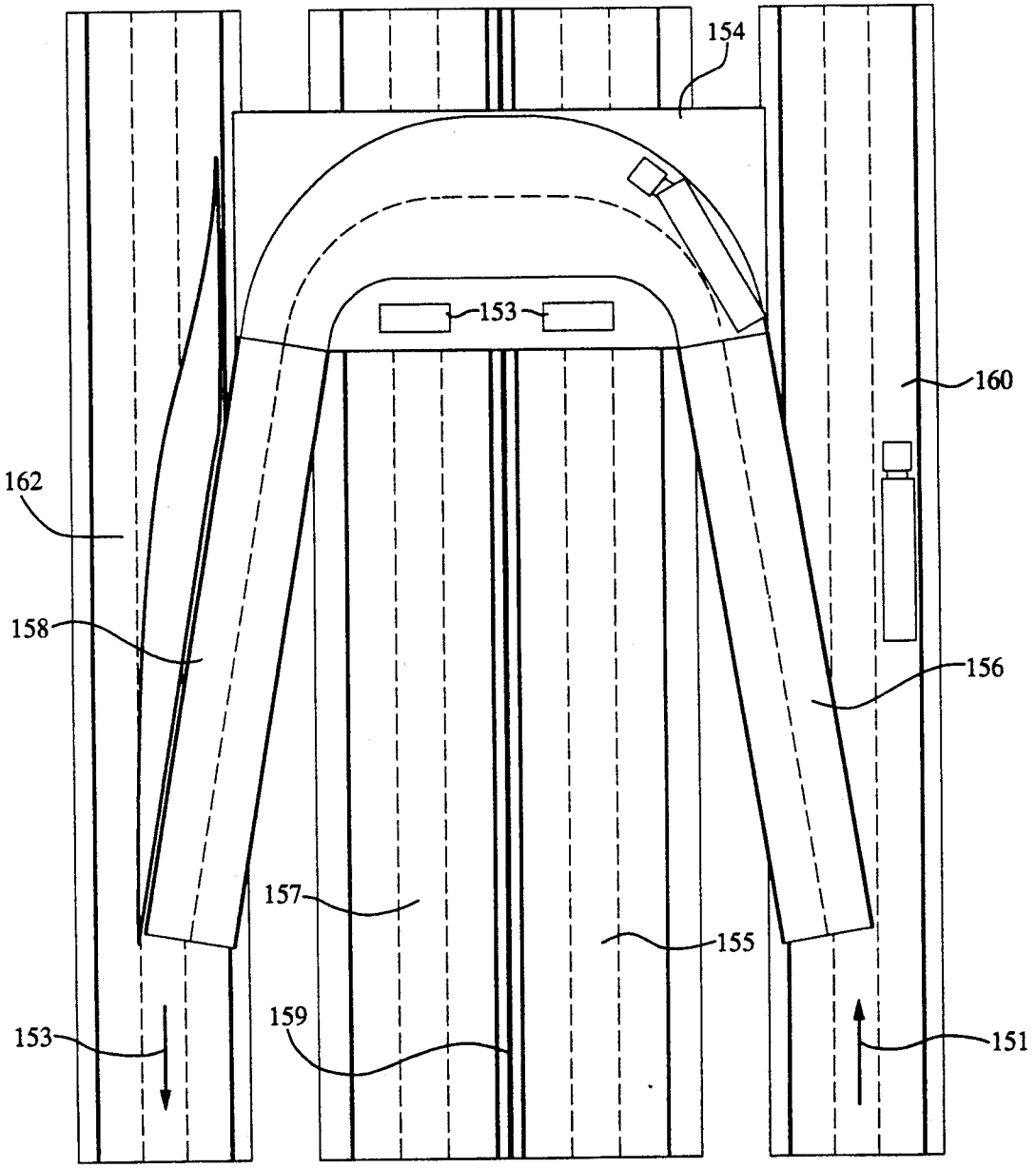
Fig.9
Fig.10
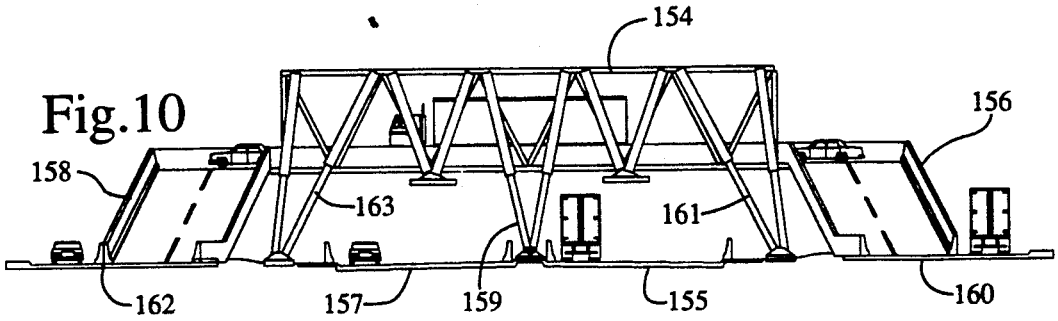

CONTINUOUSLY MOVING HIGHWAY RECONSTRUCTION DEVICE

FIELD OF THE INVENTION

The present invention relates generally to a continuously moving highway repair and construction device for preparing and surfacing a new roadbed from an existing highway with minimal interference with traffic and in particular relates to such a construction device that is multistory, that includes all lanes of existing traffic and that includes additional traffic lanes for receiving supply and material removal vehicles that can carry materials to and from the device for preparing and surfacing the new roadbed.

BACKGROUND OF THE INVENTION

Because of the growth of the number of automotive vehicles in the United States and around the world, and because many highways need reconstruction because of obsolescence or overloaded highways, the repair and reconstruction of highway surfaces has become a continuing requirement in order to keep the highways capable of carrying the large volume of traffic that must be handled. In such cases, it is always necessary to detour traffic around the repair site thus causing additional costs and delay in traffic movement. Much of it has to be one-way traffic and thus controlled by guards at each end of the detour strip to regulate the one-way flow of traffic in opposite directions at alternate times.

In order to alleviate such problems, prior art devices such as those disclosed in U.S. Pat. Nos. 4,698,866 and 3,811,147, British Patent No. 2,187,776 and German Patent No. 3,107,408 all disclose assemblies which comprise a structure provided with road wheels which support road construction apparatus on the road surface for travel thereon. The structure provides a traffic bearing surface including a rear ramp surface inclined upwardly from the rear end of the traffic bearing surface and a front ramp surface inclined downwardly from the front end of the traffic bearing surface. The apparatus includes means of driving at least some of the road wheels and steering them, road making equipment all accommodated below the traffic bearing surface such that in use the apparatus can be propelled along the road in a direction determined by the wheels. The front and rear ends of the traffic bearing surface respectively leading and trailing in the direction determined by the wheels. The traffic moving along the road in the same direction and in line with the apparatus at a higher speed than the latter can run onto the rear ramp surface from the rear of the apparatus and pass over the traffic bearing surface to run down the front ramp surface and pass on ahead of the apparatus while the road surface beneath the apparatus is simultaneously being repaired by the road making apparatus. In all these devices, the vehicle supplying materials for repair of the roadway must be either driven along side of the mobile roadway apparatus or stop traffic on the roadway surface while discharging its contents or receiving a load of waste material from under the bridge structure. Thus, in the prior art, the devices make no provision for enabling vehicles to receive and discharge materials for use in constructing the roadway from the movable roadway itself without hindering traffic. Further, the devices in the prior art all enable traffic to move in one direction only and are not able to control and handle traffic that travels in opposite directions. In addition, the structures in the prior art are limited to carrying traffic in one direction only and thus cannot accommodate traffic lanes in both directions as well as traffic lanes for supply vehicles.

The present invention overcomes the disadvantages of the prior art by providing a continuously movable highway construction device that has accommodations for traffic lanes in both directions as well as additional traffic lanes for supply vehicles to carry supplies to and from the device for the construction of the roadway taking place under the device. In addition, the novel system provides crossover bridges to enable the traffic to continue to cross the old highway when the old crossover bridges have been removed and to allow traffic to cross the new highway that's been constructed during the period of time that a new crossover bridge is being constructed. Further, the device utilizes support means having hydraulically controlled arms to position the support means such that the device can move itself in a "walking" fashion continuously along the roadway or move itself off the roadway sidewise and can adjust each leg at different heights to accommodate terrain of varying heights.

The support means can be footpads that "walk" or continuously driven tracks or wheels that move the unit in any direction but particularly in the forward direction at a rate sufficiently slow to enable the construction to take place beneath the device while allowing traffic to travel over the device at essentially normal speeds.

SUMMARY OF THE INVENTION

Thus, the present invention relates to a continuously moving reconstruction device for preparing and surfacing a new roadbed from an existing highway without stopping traffic. The device comprises a main bridge section carrying all lanes of traffic from the existing highway on one level, the main bridge section being sufficiently high above the existing highway and in such length and width as to enable preparation and surfacing of the new roadbed. Apparatus is associated with the main bridge section for preparing and surfacing the new roadbed below the main bridge section. Such preparation includes excavation and the placing of utilities such as storm sewers and taking every step necessary so the old highway is completely usable in front of the device and the new highway is completed and ready for traffic at the back end of the device. Additional traffic lanes are provided on the one level of the main bridge section for receiving supply vehicles that carry materials to and from the device for preparing and surfacing the new roadbed. Ramps are associated with each end of the main bridge section for carrying all roadway traffic up to and down from the main bridge section to the highway. A propulsion system is coupled to the main bridge section and the ramps for supporting and continuously propelling the repair and construction device while the new roadbed is simultaneously prepared and surfaced.

The invention also relates to a system for continuously constructing a roadway from an existing highway while simultaneously permitting a continuous flow of traffic. The system comprises a continuously moving main bridge section having one level for carrying all lanes of traffic from the existing highway in both directions, the main bridge section being sufficiently high above the existing highway and in such length and width as to enable preparation and surfacing of the new roadbed. Apparatus is associated with the main bridge section for continuously constructing the roadway below the main bridge section. Additional traffic lanes are provided on one level of the main bridge section for receiving supply vehicles that carry materials to and from the main bridge system for constructing the roadway. Ramps are coupled ahead and behind of the main bridge section for carrying all traffic up to and down from the main bridge section in both directions. Propulsion means are coupled to the main bridge section and the ramps for supporting and continuously propelling the repair and construction device while the roadway is simultaneously under construction below the main bridge section. Temporary cross-street units can be positioned before and after the ramps to enable temporary cross-street traffic to occur while new cross-streets are being constructed.

BRIEF DESCRIPTION OF THE DRAWINGS

These and other objects of the present invention will be more fully understood in conjunction with the accompanying drawings in which like numbers indicate like components and in which:

FIG. 9 is a top view of a cross-street detour bridge over the old highway section;

FIG. 10 is a longitudinal section of the cross-street detour bridge in FIG. 9;

DETAILED DESCRIPTION OF THE DRAWINGS

Figure 1:
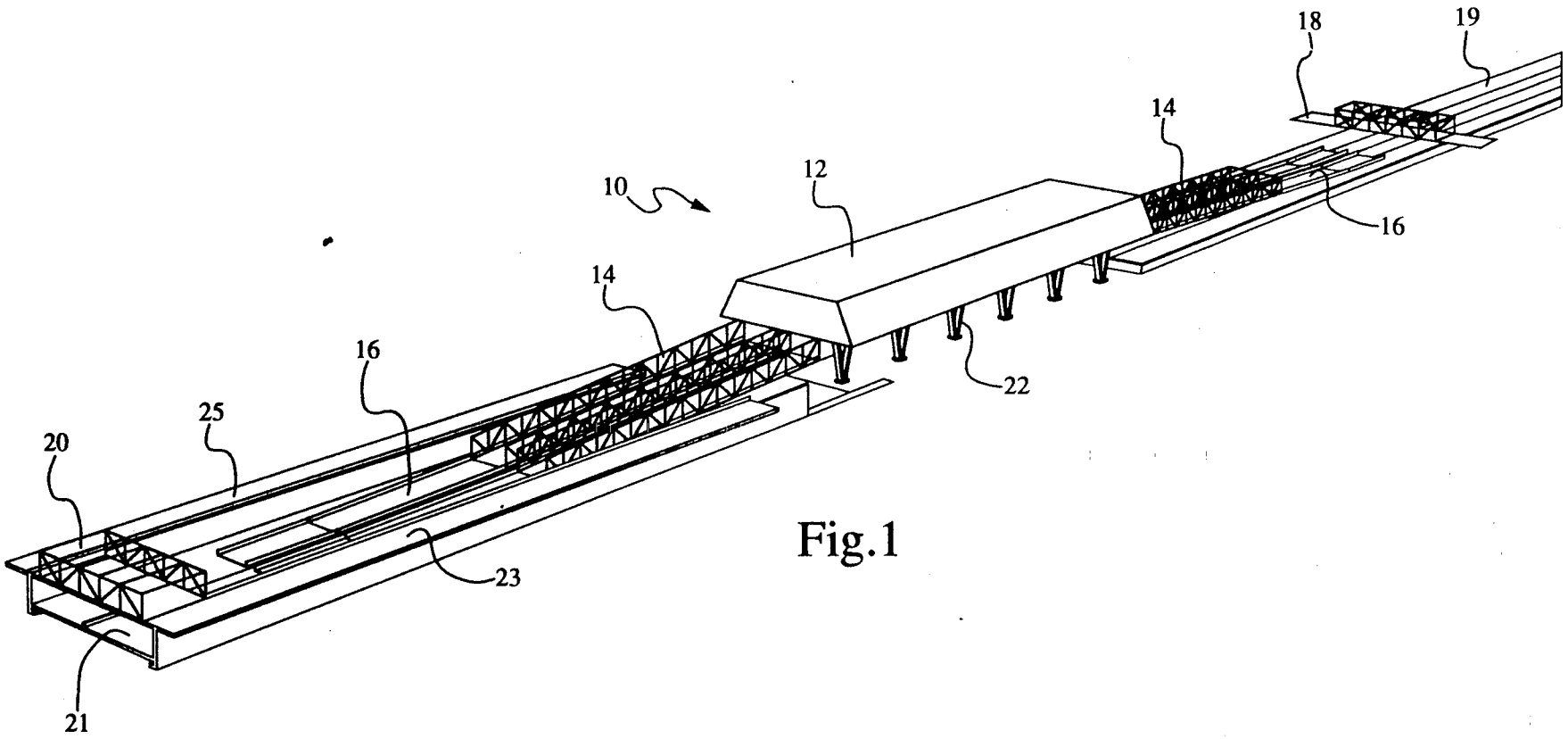
FIG. 1 is a general isometric view of the novel construction device in relation to a highway that is under construction and repair.

FIG. 1 is a generalized conceptual view of the novel continuously moving repair and construction device 10. It has 3 major sections. The first is the main bridge section 12 which is supported by movable legs 22 and under which construction and repair of the old highway takes place. Legs 22 have the capability of putting the pads such pad 60 or crawlers 140 in different locations so the bridge alignment is suitable and structures on the ground can be avoided or the ground itself will not bear the weight of the bridge 12. Attached to each end thereof is one or more bridge ramp sections 14 that carries the highway traffic up to and down from the main bridge section 12. A transition section 16 is coupled to each of the ramp sections 14 to make a smooth transition from the ramp sections 14 to the old and new highway sections 19 and 21. As can be seen in the generalized concept of FIG. 1, an old street crossover bridge 18 exists to carry traffic across the old highway 19 which happens to be at the same elevation as the main highway 19. This old bridge 18 must be removed while the device 10 continues its movement along the highway while repairing it. This means that temporary crossover bridges must be designed as will be discussed hereafter in relation to FIGS. 9 and 12. The crossover bridge 20 for the new highway 21 is a temporary device that will be discussed in relation to FIG. 12 and is self powered so that it can move to a new location as desired when a new crossover bridge has been constructed. It is designed without ramps because the new highway is at a different elevation than the frontage roads. Frontage roads 23 and 25 are shown in FIG. 1 and may be constructed either separately from the construction of the roadway beneath the main bridge section 12 or may be constructed in conjunction with the construction of the new highway by the device 12.

Figure 2A:
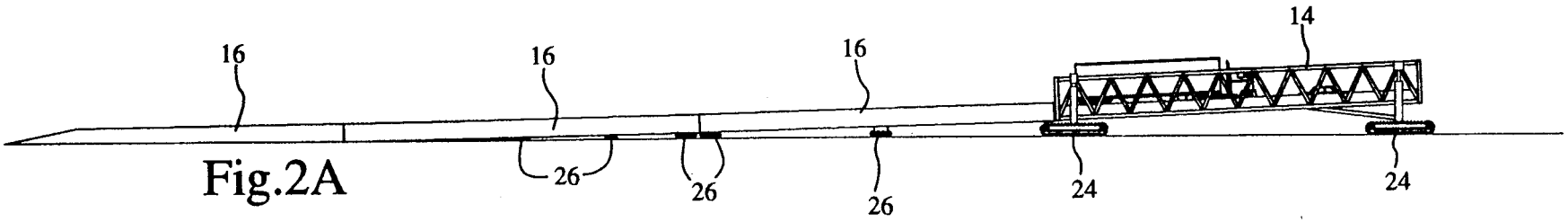
FIGS. 2A, 2B and 2C are side views of the ramp portion of the device at one end thereof connected to a transition ramp to carry traffic down to the roadway or up to the device.
Figure 2B:
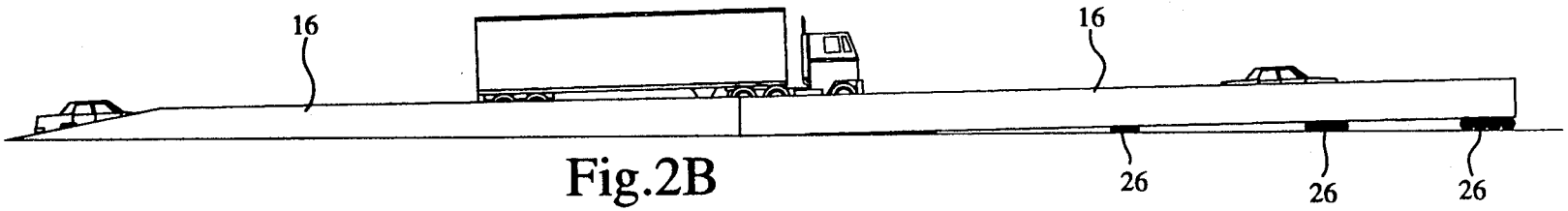
Figure 2C:
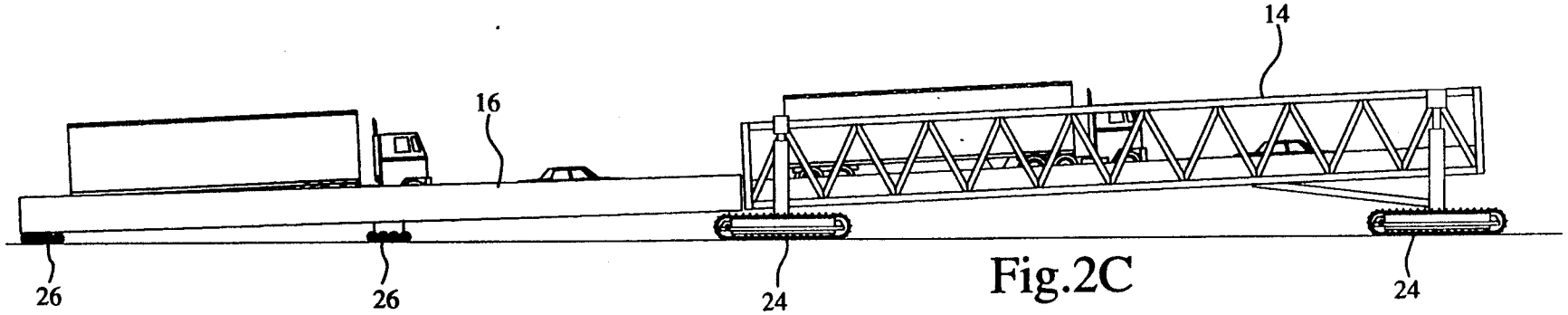

FIGS. 2A, 2B and 2C illustrate two of the bridge ramps 14 coupled to each other and to the associated transition section 16 in any well-known manner as by articulated couplings that enable the device to move along curved roadways. The bridge ramps are long and gradual enough so that normal speeds and therefore traffic volumes are maintained. It will be noted that the ramp sections 14 are mounted on support and power devices 24 such as, for example only, continuous crawler, tracks that are powered by any well-known means. In addition, the transition section 16 rests on a plurality of smaller wheels 26 so that it can be moved in conjunction with ramp section 14 and the main bridge section 12 and distribute the load. Thus, highway traffic is carried downward from and upward to the main bridge section 12.

FIGS. 3A–3E are side views of a generalized conception of the main bridge section 12 illustrating the various functions thereof. It can be seen in FIGS. 3A–3E that the structure 12 has four levels 28, 30, 32 and 34. It illustrates material 36 from the old roadbed being removed by an excavator 38 and the removed material being carried by a conveyor belt 40 to a partial lift device or conveyor 42 that carries the material up to a second conveyor belt 44 on level 32 and carried to waiting vehicles 46 and 48 which are supply vehicles that bring material to and carry material away from the main bridge section 12 for construction of the new highway. It will be noted that the structure 12 is mounted on a plurality of support pads 50, 52, 58, 60 and 61. To each of these pads is connected at least three extensible struts 62, 64 and 66 which may operate in any well known manner such as by hydraulics, electrically driven screws and the like but will be discussed herein for clarity as hydraulically driven fluid cylinders. These hydraulic fluid cylinders 62, 64 and 66 can be manipulated such that the device can accommodate itself to various terrain levels as illustrated by the footpads 50 and 52 which are on higher levels of earth than footpads 58 and 60 and to avoid structures or soft spots or holes in the path of movement. Further, some footpads 61 are entirely retracted. In addition, these hydraulic fluid cylinders 62, 64 and 66 can cause the device to "walk" in the forward direction as will be illustrated hereafter in relation to FIGS. 3F-3K.

A culvert 68 can be seen in a trench underneath the device 12 with the culvert being placed there during construction of the roadway under the main bridge device 12. Trucks 70 are illustrated on the second level 30 delivering material to hopper 72 where the material is carried by a conduit 74 to a second hopper 76 and from thence to a conduit 78 and to the paving machine 80 under the structure 12. In like manner, the material from the second truck 70 is carried through a conduit to hopper 76, conduit 78 to the second paving machine 80.

Stored rebar 82 may be used to form concrete side walls 84 for supporting frontage roads. Additional rebar for storage 86 may be supplied by vehicle 87 on second level 30 and used in the construction of the concrete side wall or if the highway being repaired is to have a concrete surface, the rebar can be used in the concrete surface. Stored rebar 88 may be used for the same purpose. A concrete mixer 90 is illustrated on the top deck of the structure 12 and receives material from a hopper 92 that is replenished in any well-known manner such as supplying water by a conduit 94. The supply hopper 92 may include water, concrete, aggregate and other material as necessary. The mixed concrete from mixer 90 may be fed through conduits 96 to various areas under the main bridge section 12 where it is needed to complete finishing of the highway and the side walls.

As stated previously, the support pads 60 are coupled to hydraulic fluid cylinders 62, 64 and 66 not only for support but also to move the system continuously as the work is progressing below the main bridge section 12. The support pads 60 may be flat rectangular pads, circular pads having a convex outer surface or other types as desired. However, for simplicity of discussion, they will be noted as flat, rectangular pads herein. Thus, the hydraulic legs 62, 64 and 66 "walk" the pads 60 as illustrated in FIGS. 3F-3K. Legs 62 and 64 carry the majority of the weight and provide for fore and aft motion of pad 60. Hydraulic leg 66 provides transverse motion of pad 60 and compensates for any side forces. It provides no substantial fore and aft motion to pad 60. With a footpad 60 in the position illustrated in FIGS. 3F-3K, the hydraulic support legs 64 and 66 can be shortened and the hydraulic leg 62 lengthened to cause the main bridge section 12 to move to the right in FIGS. 3F-3K to the positions as shown. If the cylinders 62 and 66 are lengthened and the cylinder 64 is shortened, the main bridge section 12 will move as illustrated in FIGS. 3F-3K. At that point, all three hydraulic legs 62, 64 and 66 can be shortened, thus lifting pads 60 off the surface as illustrated by pad 61 in FIG. 3A. In this position, the remaining legs support the main bridge section 12 while the cylinders 62, 64 and 66 are used to reposition the pad 60 to the position as illustrated. The cycle then repeats itself. Of course, the legs do not move simultaneously, but are moved in a computer generated succession so that the unit 12 crawls in a forward direction at about three feet per hour, or 72 feet per day.

Figure 3A:
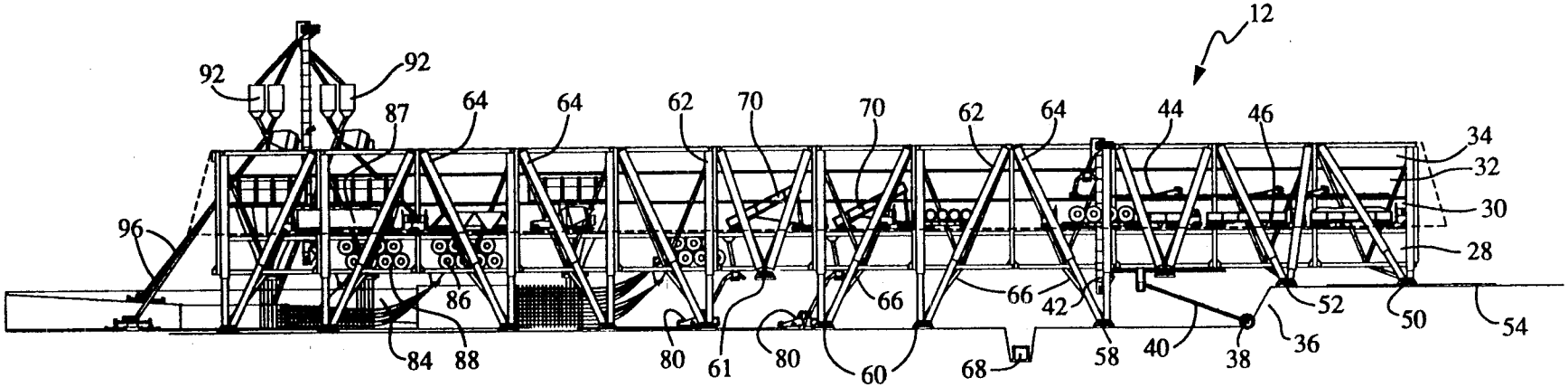
FIGS. 3A, 3B, 3C, 3D and 3E are conceptualized side views of the novel device illustrating the various levels on which traffic flows, construction apparatus is located and construction materials are stored and utilized.
Figure 3B:
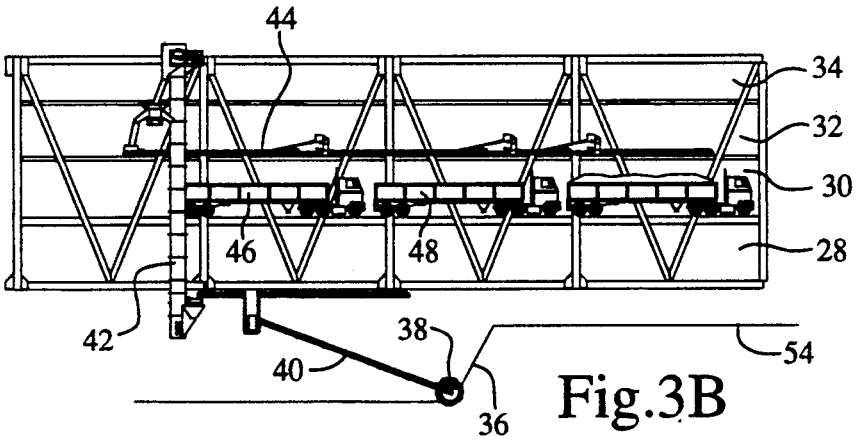
Figure 3C:
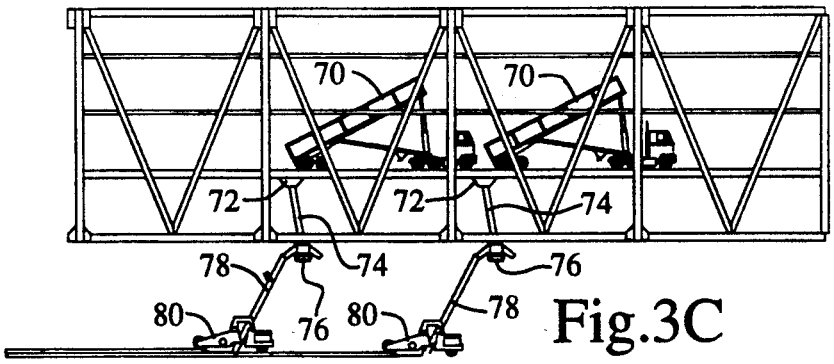
Figure 3D:
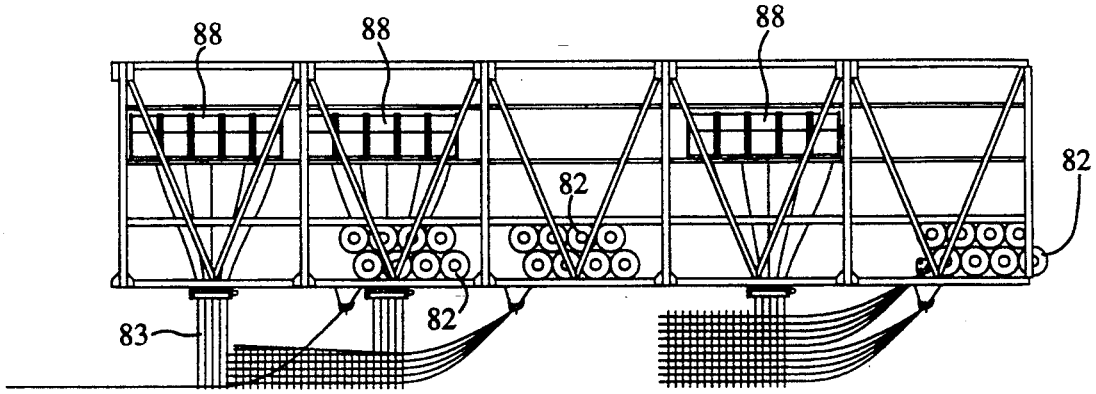
Figure 3E:
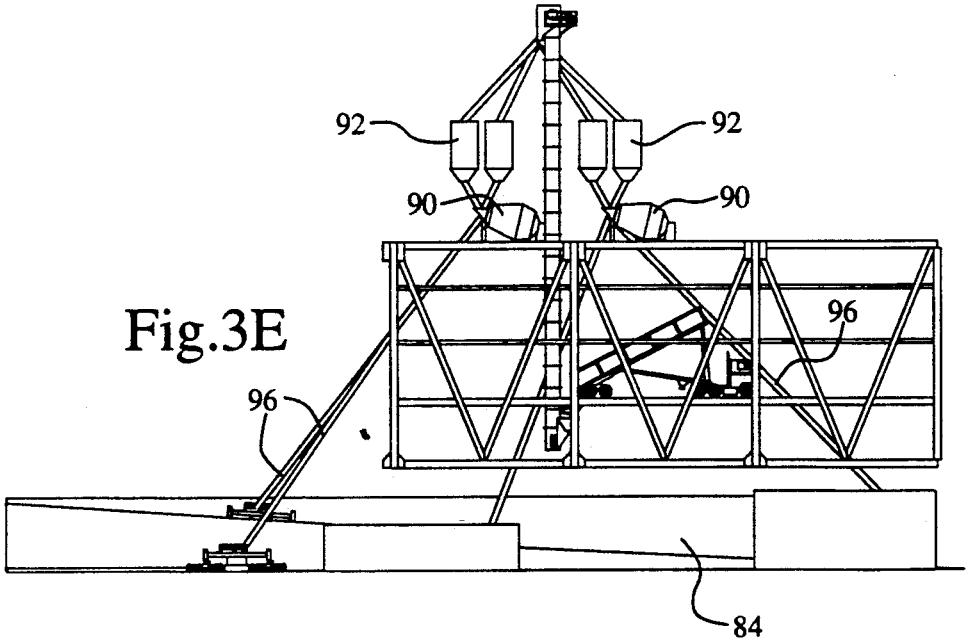
Figure 3H:
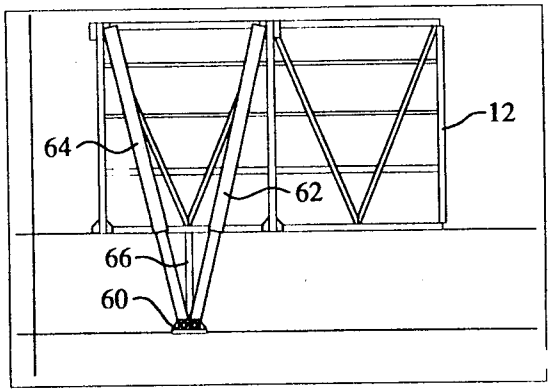
FIGS. 3F–3K show the hydraulic support legs can continuously move the device in a forward direction.
Figure 3G:
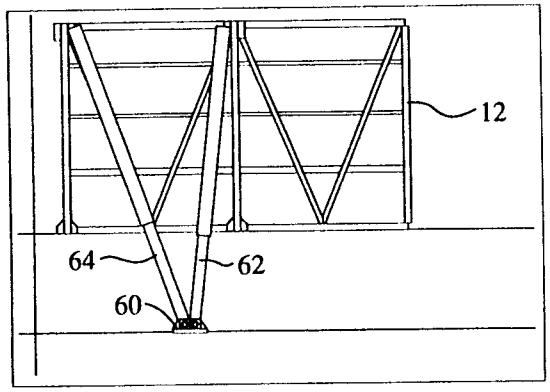
Figure 3F:
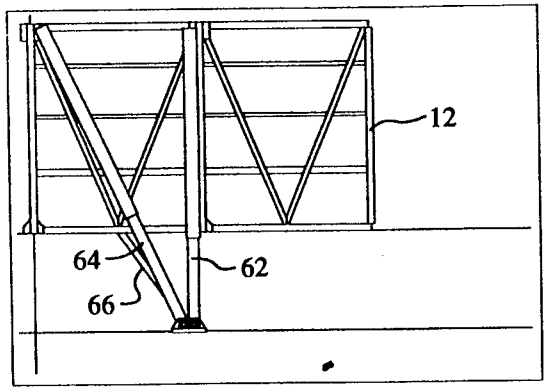
Figure 3K:
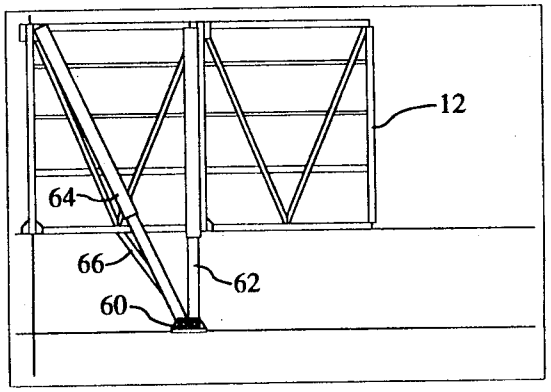
Figure 3J:
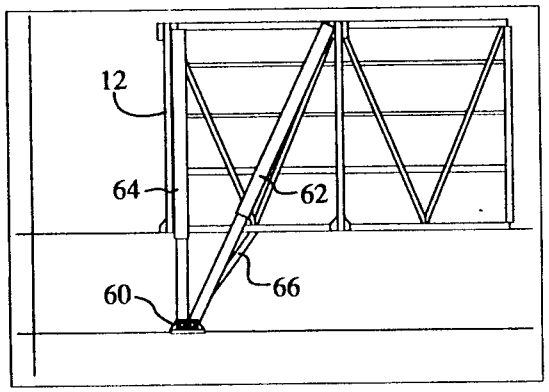
Figure 3I:
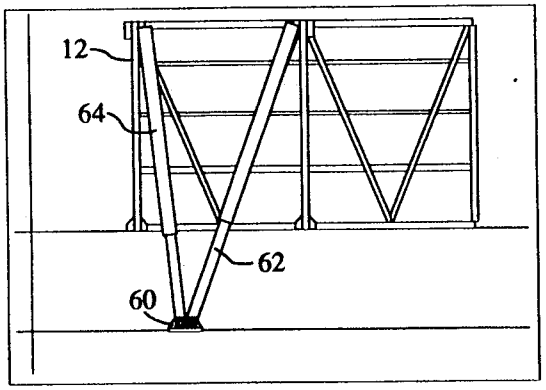

Thus, the unit illustrated in FIG. 3A carries up to six lanes of traffic over the construction area. The traffic deck 30 shown in FIG. 3A could, of course, be on the first level 28 or any other level as desired. By putting the traffic deck on first level 28, the slope of the ramps 14 and 16 would be less in getting the traffic down to an up from the highway.

As will be seen in FIG. 4, level 30 of the main bridge section 12 carries up to three lanes of traffic in areas 122 and 123 in both directions over the construction area as well as three lanes of traffic in area 125 for service vehicles to provide material to and receive material from the construction area below the main bridge section 12. The lowest deck 28 is elevated sufficiently to provide clearance for the excavation and construction equipment below the main bridge section 12. In the preferred embodiment, this main bridge section 12 is approximately 120 feet wide by 600 feet long. The ramp bridge sections 14 provide ramps at a maximum grade of 6% to carry traffic up to and down from the main bridge section 12. These ramp bridges 14 provide the major adjustment between the elevation and alignment of the existing roadway on one end and the new roadway on the other. There are preferably two sets of ramp bridges 14 at each end to allow for independent alignment of the traffic lanes in each direction. These ramp bridge sections 14 will be in the preferred embodiment at least 3 lanes wide by 150 feet long. It may be required in some cases for four and perhaps five sections to be required for each ramp bridge. If it is decided to carry trucks removing spoil and bringing in material to the main bridge section 12, each of the ramp bridges will carry an extra separated lane to hold trucks quelling for loading and unloading. Ramp bridges will also include guard rails and energy absorbing systems at the start of the guard rails. The transition sections 16 are low ramps that provide a gradual transition in grade and elevation from the highway to the first ramp bridge 14. The transition sections 16 will start with a one-quarter inch thick edge on the highway and will end at a joint similar to a bridge expansion joint at the orthotropic bridge deck which is nominally 10 inches thick. Depending on the difference in grade of the highway and the main bridge section 12, the end of the transition section 16 coupling to the ramp bridge sections 14 will be 10 inches to 18 inches above the highway. The transition sections will be 72 feet long and two or more of the parallel transition sections 16 will be used in the transition from the old highway to the ramp bridge sections 14.

Figure 4:
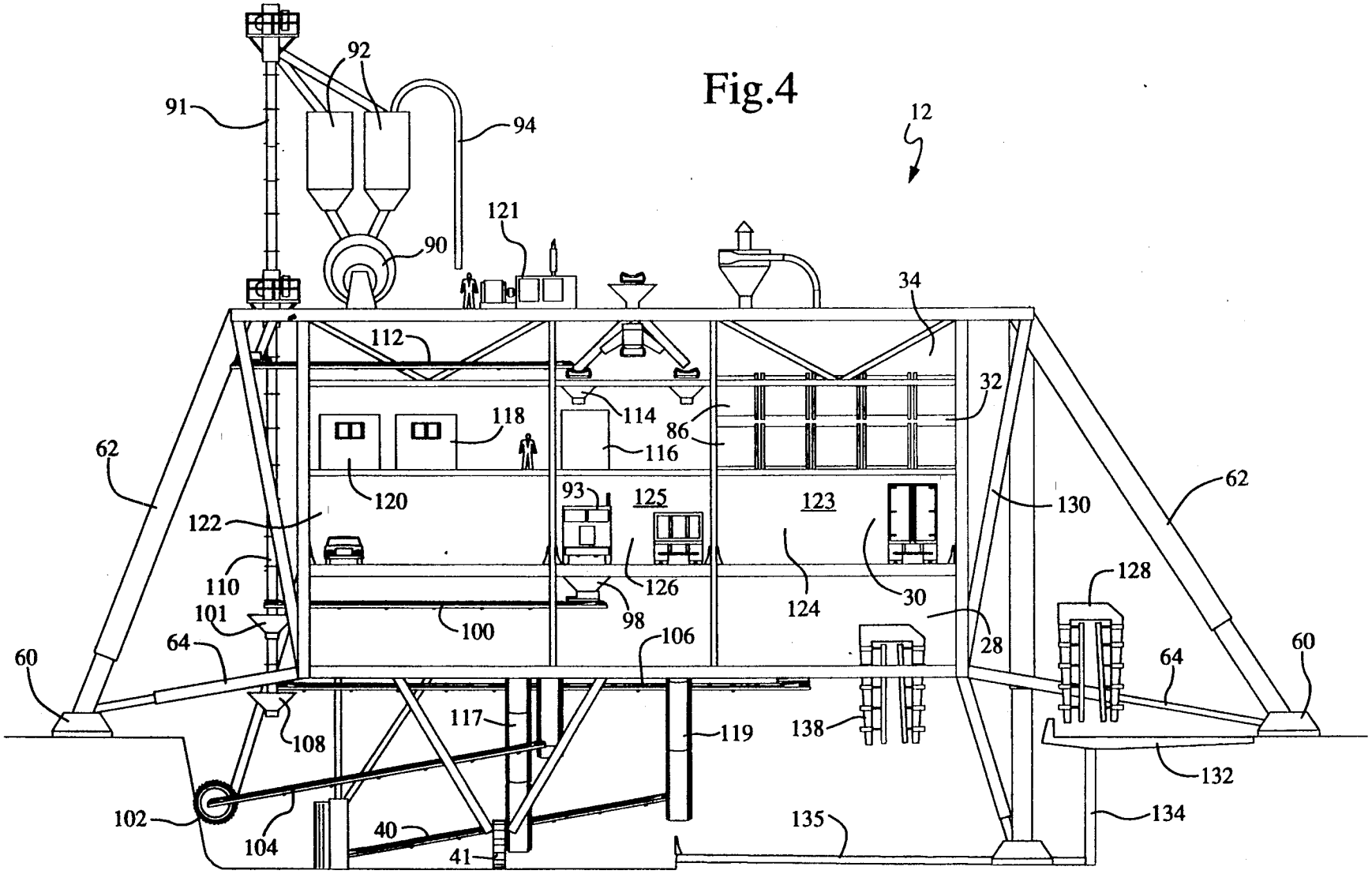
FIG. 4 is a generalized cross-sectional view of the device illustrating the traffic lanes that carry traffic in both directions as well as the traffic lanes for the supply vehicles, illustrates the power machinery underneath the device for preparing the roadway and the machinery above the device for providing the necessary supplies to construct the roadway underneath.

FIG. 4 is a generalized cross-sectional view of the novel main bridge section 12. Again, the four levels 28, 30, 32 and 34 are shown with level 30 including 6 lanes of traffic to and from the old highway with 3 lanes in each direction in areas 122 and 123 and 3 lanes in the center area 125 for use by service vehicles 93 to supply material to and receive material from the unit 12 in the construction of the highway underneath. It will be noted that at least some of the pads 60 on each side of the unit 12 are extended outwardly by means of the hydraulic actuator 64 and thus can be positioned at different distances away from the side of the main bridge section 12. The lower right side of FIG. 4 illustrates the newly completed section of highway 135 with a bridge support 134 for the frontage road 132 being of the cantilever type and installed in place. As can be seen in FIG. 4, the main bridge section 12 is able to build the frontage roads if needed. However, the frontage roads may be built in advance of the construction of the main highway 135 if desired. Forms 128 may be used in the construction of concrete side walls 134 and can be stored on the main bridge section 12 as indicated. Further, an excavator 102 may extend by hydraulic means from either side, but is shown in FIG. 4 from the left side, to prepare embankments for the new roadway and frontage roads as illustrated. The material excavated by unit 102 is deposited on conveyor belt 104 that carries the material upward to conveyor belt 106. In addition, the excavators 38 and 41 for excavating in the forward direction also deposit material removed on conveyor belt 40 and the material is carried to cooperating conveyor belts 117 and 119 which also deposit the material on conveyor belt 106. From conveyor belt 106 the material is deposited in hopper 108, carried up a tower 110 to conveyor belt 112 where it is deposited through hopper 114 into a container 116. Container 116 may then deposit the material into service vehicles 93 for being removed as necessary. It will be noted in FIG. 4 that the excavating unit 38 is controlled by an arrangement of hydraulic cylinders 39 to move the unit vertically and in orthogonal directions horizontally to remove material as needed. Materials may also be carried by trucks 93 to be deposited in hopper 98 and carried by conveyor belt 100 to hopper 101. From there the materials are carried up tower 9 1 to storage bin 92 for use by concrete mixer 90, as illustrated in FIG. 1 and discussed previously. Computers 118 and 120 provide all of the necessary controls for moving the hydraulic legs 62, 64 and 66 to move the pads 60 such that the unit walks. Power supplies 121 and other equipment may be kept on any of the levels 28, 32 and 34 as desired.

Figure 5:
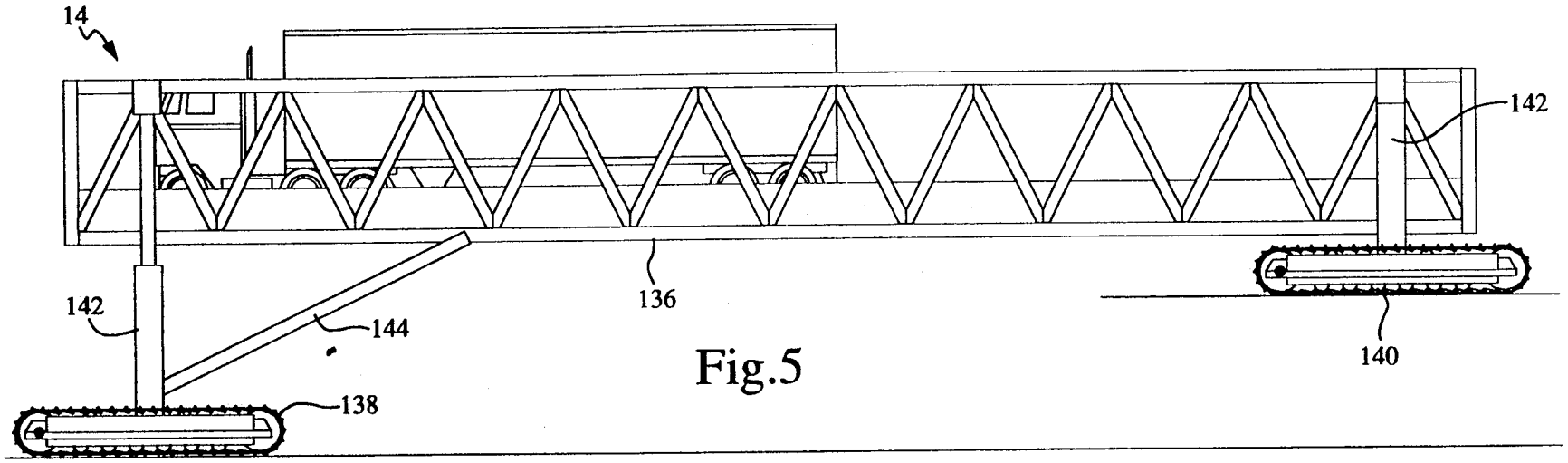
FIG. 5 is a side view of a section of one of the ramp sections illustrating the use of endless tracks on the hydraulic support legs to provide power for moving the ramp sections and illustrating how the tracks can operate at different elevations by means of the hydraulic supports.
Figure 6:
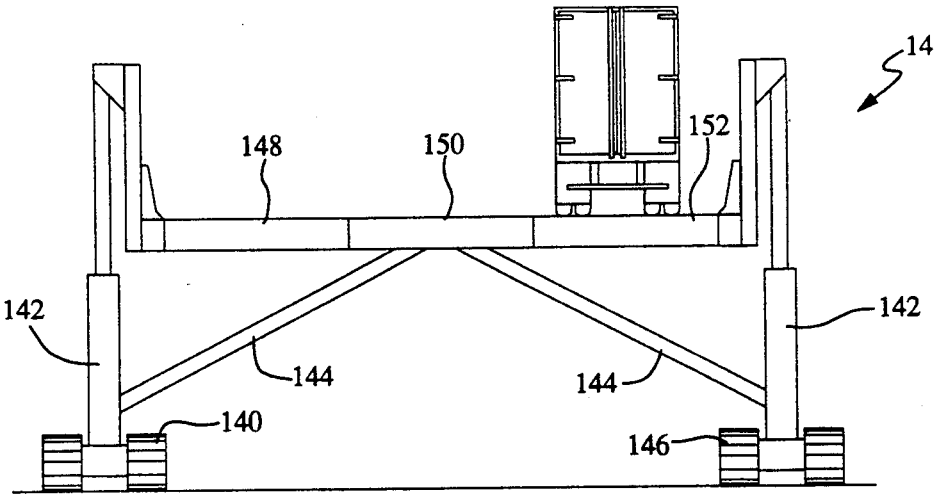
FIG. 6 is an end view of the ramp section in FIG. 5 illustrating the hydraulic lift cylinders at their maximum height position and the tracks in their narrowest position.
Figure 7:
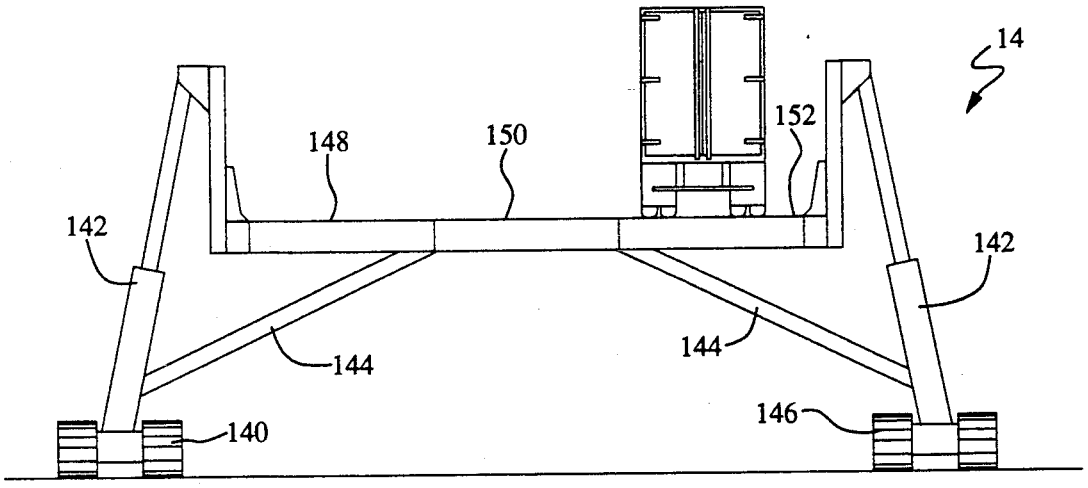
FIG. 7 is an end view of the ramp section illustrating the crawler tracks being at their widest spread possible.
Figure 8:
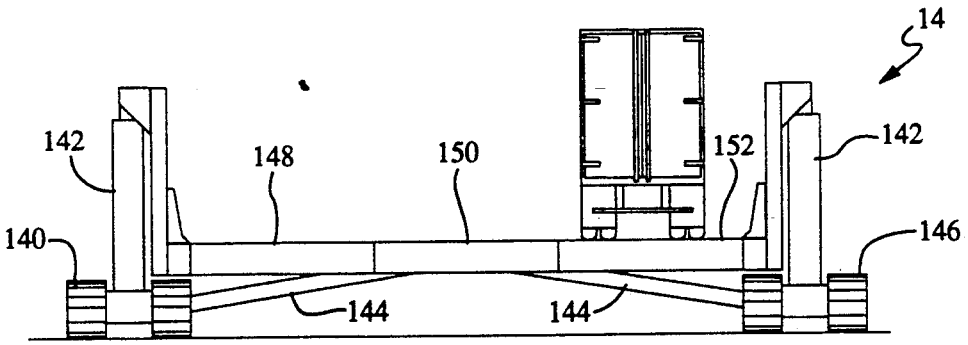
FIG. 8 is an end view of the ramp section illustrating the hydraulic lift cylinders retracted and the ramp in its lowest possible position.

FIG. 5 is a side view illustrating one of the ramp bridge sections 14. It will be noted that it is powered by continuously driven endless crawler track units 138 and 140 that are attached to extensible struts such as hydraulic cylinders 142 and 144. Hydraulic cylinder 142 allows the track unit 140 to be positioned in elevation as shown to compensate for terrain variations while holding the deck portion 136 in a desired horizontal position. In addition, as illustrated in FIGS. 6 and 7, the hydraulic cylinders 144 may pull the tracks 140 and 146 inwardly or outwardly to adjust the clearance of the unit 14. Thus, again the tracks may be positioned as necessary for terrain purposes. FIG. 8 illustrates the ability of the cylinders 142 to raise and lower the deck 136 carrying the three lanes of traffic 148, 150 and 152 from the elevation illustrated in FIG. 6 to that shown in FIG. 8. Again elevations can be adjusted as necessary to provide for a gradual transition from the main bridge section 12 to the transition sections 16. While continuous crawler tracks 138, 140 and 146 are illustrated in FIGS. 5, 6, 7 and 8, it should be understood that footpads such as footpads 60 shown in FIG. 3A could also be used and the sections 14 could be walked as described earlier with relation to the main bridge section 12. The legs would be controlled by a computer such as computers 118 and 120 on main bridge section 12 to ensure stability and proper motion of the unit. In like manner, the main bridge section 12 could move on continuous crawler tracks or other means instead of hydraulically controlled footpads.

Figure 11:
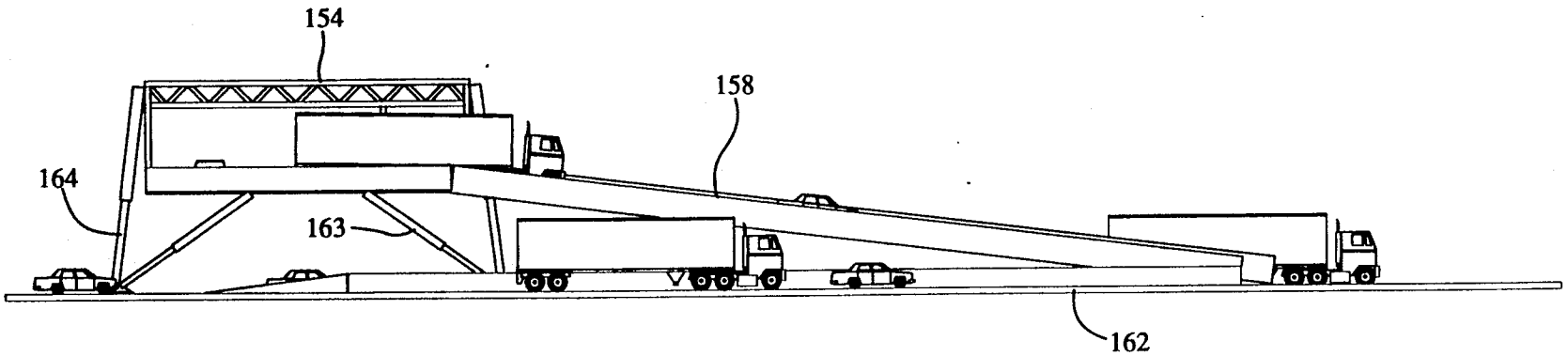
FIG. 11 is a side view of the cross-street detour bridge of FIG. 9.
Figure 12:
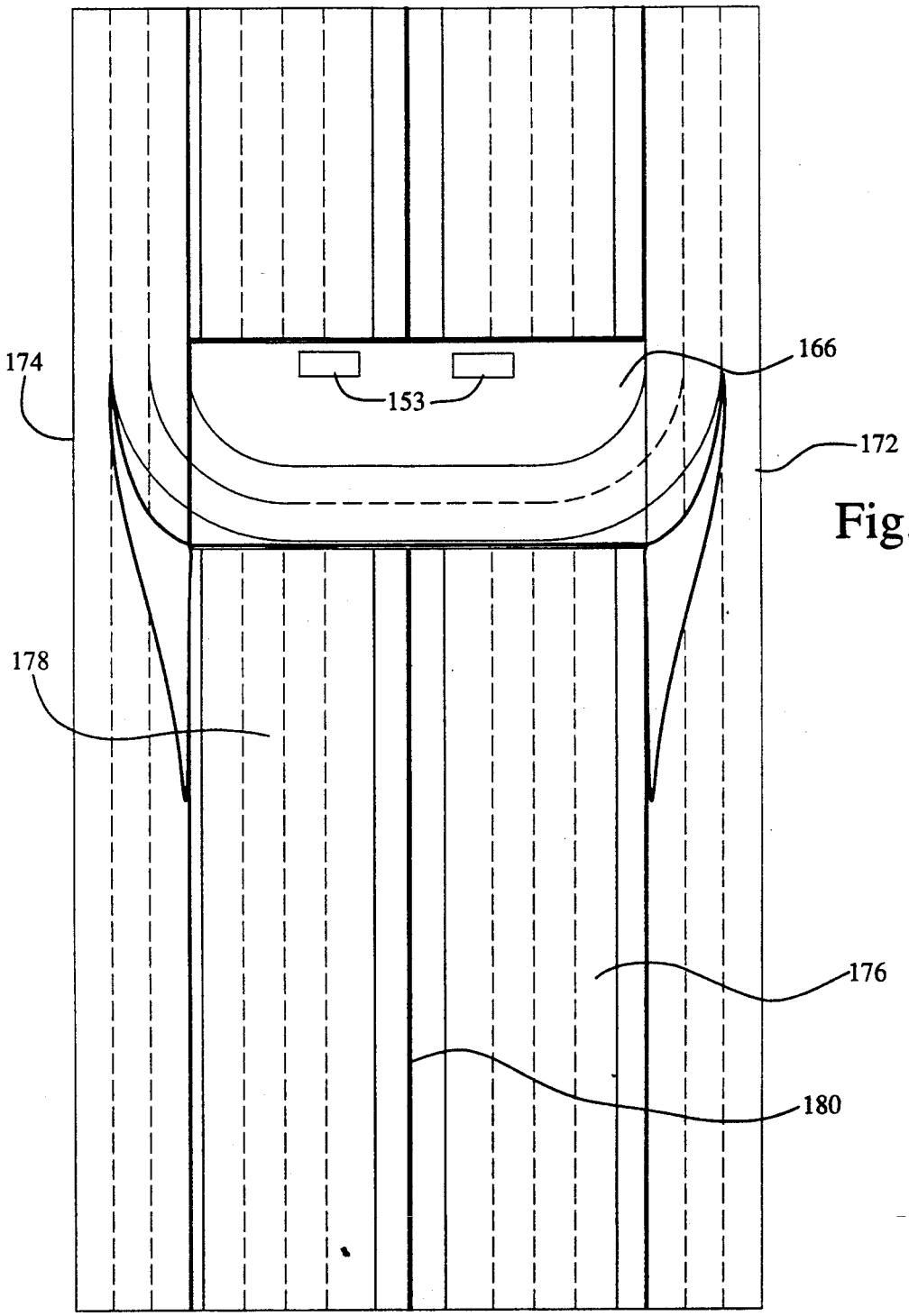
FIG. 12 is a top view of the cross-street detour bridge over the newly repaired highway.

On highways in cities where cross bridges are used, it may be necessary to provide cross bridges to handle traffic between frontage roads on opposite sides of the expressway under construction and are in effect U-turns. While the main set of bridges 12 are passing a cross street, the old cross-street bridge will of necessity be closed. To prevent overload of adjacent cross-street bridges, detour traffic will be handled by cross bridges 154 and 166 as illustrated in FIGS. 9 and 12. Cross-street bridges 154 and 166 can be constructed with one or more removable sections to adjust for gross differences in distances between opposing frontage roads. As can be seen in FIG. 10, cross-street section 154 is mounted on legs 161 and 163 that again are movable legs powered by any well known means as explained with reference to main bridge section 12 and controlled by computer 153 so that the legs can walk to move the bridge section 154 into place. Bridge section 154 has ramps 156 and 158 attached to it and extending down to the frontage roads 160 and 162. Traffic intending to cross the old highways 155 and 157 and divider 159 enters frontage road 160 and turns in the direction of arrow 151. The traffic enters ramp 156, crosses over bridge section 154 to ramp 158 and down to frontage road 162 in the direction of arrow 153 where the traffic can go back to the cross street road where the old bridge had been previously located. The ramps 156 and 158 are shown clearly in the longitudinal section illustrated in FIG. 10. They can be adjusted vertically to match the elevation of frontage roads 160 and 162 in the manner previously described in relation to main bridge section 12. FIG. 11 is a side view of the cross-street bridge 154 and ramp 158 illustrating legs 163 and 164 on which the bridge 154 is mounted and which can walk to move the bridge 154 into and out of place over the highway. The legs 161, 163 and 164 may be hydraulically operated as discussed previously in relation to the main bridge section 12 illustrated in FIGS. 3A–3K. This means that the bridge unit 154 can be assembled to one side of the highway to be reconstructed and can walk over the highway at sometime during the night hours to minimize disruption of traffic.

FIG. 12 is a top view of the cross-street detour bridge 166 over the newly constructed highway traffic lanes 176 and 178 that is used to divert traffic across the highway until the new bridge is completed in its construction. The detour bridge section 166 is designed so that it can fit between the frontage roads 172 and 174 without the use of ramps as shown in FIG. 13.

Figure 13:
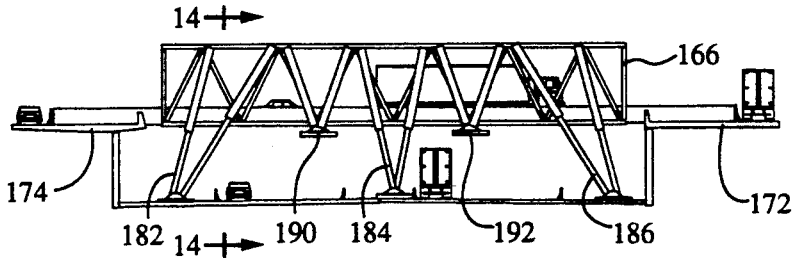
FIG. 13 is a longitudinal section of the cross-street detour bridge of FIG. 12.

As can be seen in FIG. 13, a longitudinal section is illustrated showing the cross-street detour bridge 166 positioned between frontage roads 172 and 174. The cross-street detour bridge 166 has six footpads and support structures 182, 184, 186, 188, 190 and 192 which are adjustable in elevation and transverse position by computer 153 to enable the bridge to be positioned as needed. For instance, in FIG. 13, legs 182, 184 and 186 are extended and sit on the finished roadway surface while legs 188, 190 and 192 are withdrawn as illustrated. Vehicles simply come along frontage road 174, cross the structure 166 and enter frontage road 172 on the other side to the connecting highways that would normally take traffic across the roadway.

Figure 14:
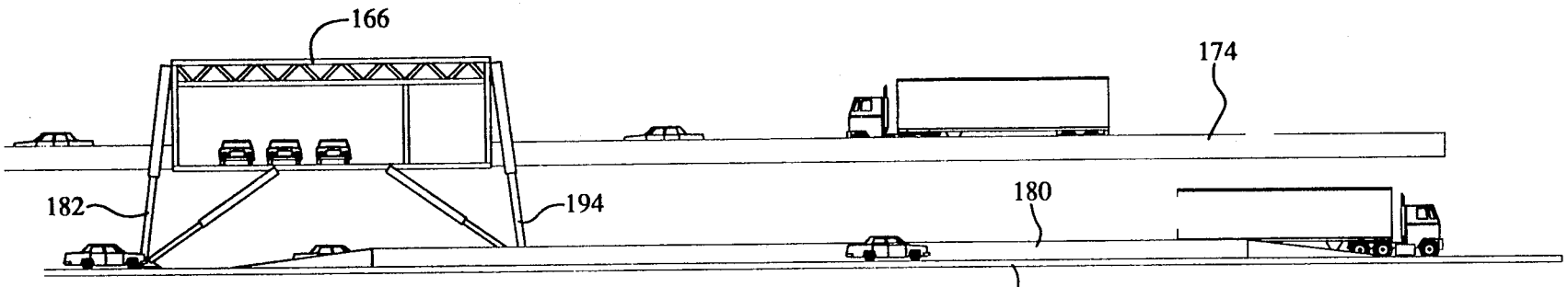
FIG. 14 is a side view of the cross-street detour bridge of FIG. 12.

FIG. 14 is a side view of the bridge section 166 illustrating the vehicles on frontage road 174 and crossing bridge section 166. It will be noted in FIG. 13 that legs 184 are positioned on the median 180 out of any of the traffic lanes.

Figure 15A:
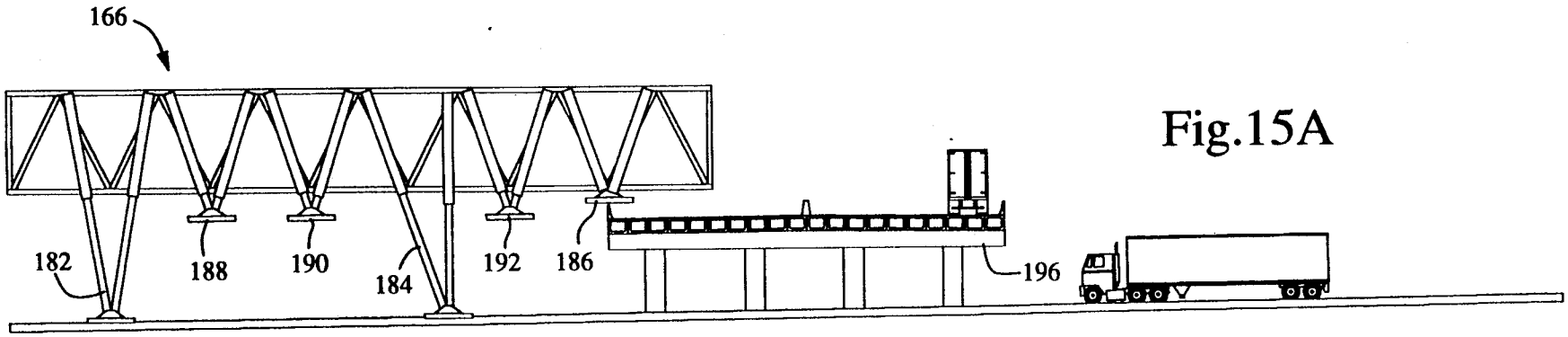
FIGS. 15A, 15B and 15C illustrate the cross-street detour bridge having been rotated by movement of its legs and illustrating its capability to move to a new location across the new bridge that has been constructed and is now ready for use.
Figure 15B:
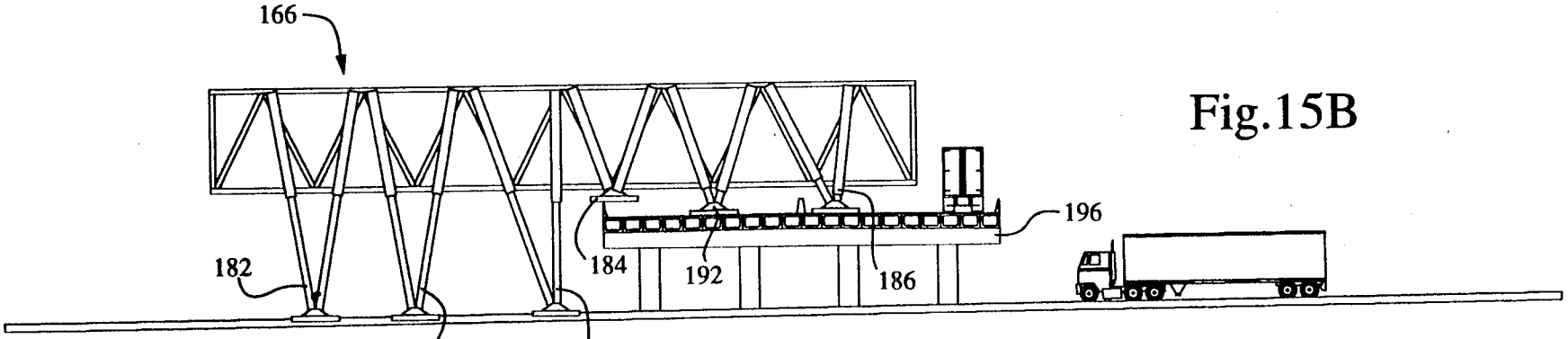
Figure 15C:
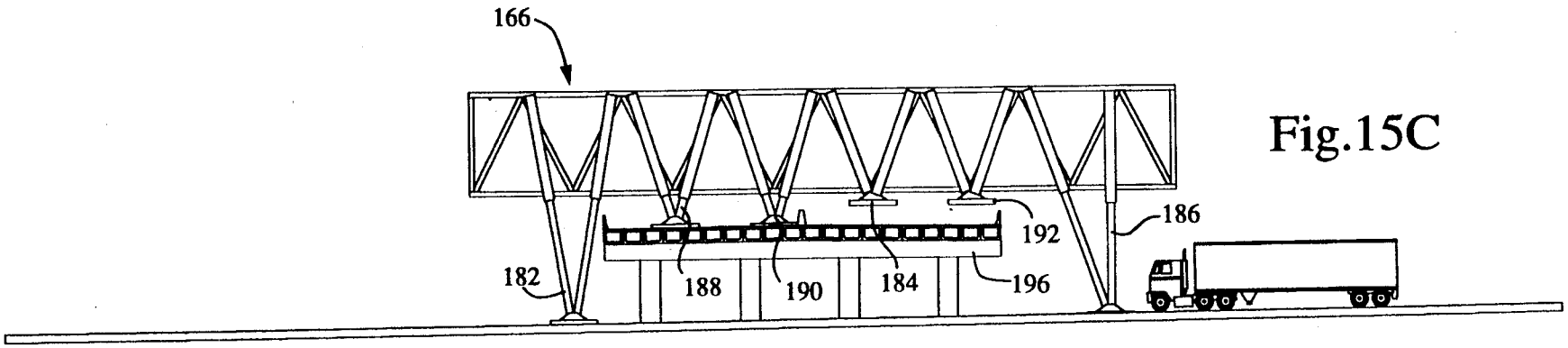

When the new bridge 196 has been constructed for carrying traffic across the new highway, the structure 166 can be moved. The legs 182, 184, 186, 188, 190 and 192 are operated so as to cause the bridge structure 166 to turn perpendicular to the bridge structure 196 and parallel with the newly constructed highway. By successively raising and lowering the legs 182–192, the bridge structure can walk across the new bridge structure 196 as illustrated in FIGS. 15A, 15B and 15C. Where there is a lengthy portion of the cross-street detour bridge 166 extending over the new bridge section 196, one of the legs 182-192 can be placed with some force onto the bridge surface 196 in order to stabilize the cross-street bridge section 166 and prevent it from tipping. Thus, in FIG. 15A, leg 186 could be lowered to the surface of new cross-street bridge 196 for support as desired. Those instances would occur as the bridge is in the position illustrated in FIGS. 15A and 15C.

Thus, the legs and span of these cross-street bridges will be of sufficient length to allow them to clear an old or new cross street while moving from one side of the cross street to the other as illustrated in FIGS. 15A, 15B and 15C. The legs also allow fast assembly off of the roadway and walking up or down embankments without tipping or being angled excessively. These cross-street bridges are relatively fast moving and will be able to move at 1000 feet per hour. They are wide enough to permit a generous radius for two U-turn lanes when in place. As indicated, these bridges are stationary when in use and will be moved to new positions when an old cross street is closed and a new cross-street bridge is ready for traffic. Typically, these bridges will be relocated about once a month during the night hours. The ramps 156 and 158 shown in FIG. 10 carry traffic from the frontage roads to the cross bridges and align with the frontage roads. In locations where the cross bridges are significantly elevated above the frontage roads, the cross-street ramps will handle a difference in elevation.

The apparatus will be set up on or near the site for construction start. The main bridge section 12 will be assembled with the main bridge truss, decking, siding and roofing, legs will be installed, equipment placed on the various levels, all power and control circuits hooked up and the movement system tested. The ramp bridges 14 will be assembled with the truss and decking, installation of legs and the control system and movement will be tested. The transition sections 16 will have decking, pads and guardrails assembled. These sections will be laid down on the roadway when all other complements are ready. The cross-street bridges will have their decking and truss assembly installed, legs installed and the control system and movement tested. When all the complements are ready, the main bridge section 12 will be walked from its assembly position to the start-up position straddling the highway to be repaired. Except for the time needed to cross the main lanes, expressway traffic will not be affected. When the bridge is aligned with the highway to be repaired and just off the edge thereof, traffic on the highway will be stopped and the bridge will walk across the traffic lanes in this area. This will take about four hours and will preferably take place over a Sunday evening. The highway traffic will operate under this bridge until all sections of the ramp bridges 14 are in place and ready to use. The ramp bridges 14 will also be walked across the traffic lanes and connected to the main bridge. The legs of these ramp bridges will remain extended so that traffic is driven under them. The two-lane transition sections will be put in place and the ramp bridges 14 lowered and connected to the transition sections 16. From then on, all highway traffic will be routed over the device. Once traffic is being carried over the construction site, the various excavators, compacting and concrete form equipment will be put in place. While the bridge section 12 is in its initial position, the area under the bridge section 12 will be excavated, conditioned and trimmed by the various processes and devices associated with the main bridge section 12. Paving and wall construction will then be started. Construction will proceed at an average rate of 72 feet per day. While construction can continue three shifts per day, unexpected circumstances could cause this process to stop. An example might be a utility crossing that was not relocated or an unusual soil condition.

As each cross street is approached, the replacement of the cross-street bridge will take place as follows. Sometime before the transition sections approach a cross street, the temporary cross-street bridges 154 and 166 will be put in place. When the bridges are in place, cross-street traffic will be split and detoured over them. On a north-south highway, with construction taking place to the south, eastbound traffic will turn right at the southbound frontage road and will proceed south to the temporary bridge. Here it will cross over the old highway segment still in use and turn back north to the old cross street. A right turn there will end the detour for eastbound traffic. Westbound traffic will have a symmetrical detour going around the north end of the construction area and crossing over the newly constructed expressway between the frontage roads. The eastbound cross-street bridge will be placed half way between the affected cross street and the first cross street to the south. As the profile of the main highway and frontage road are usually at similar elevations, this cross-street bridge will have ramps from frontage road elevation to cross-street elevation. The cross-street bridges are designed to be moved from one position, travel along the highway and be repositioned in two evenings at most.

As the first sections of the transition sections reach a cross-street bridge, the cross-street bridge deck will be removed. The supports for the original cross bridges can be removed between or adjacent to ramps as they pass. As the main bridge section, ramp sections and transition sections move by, the supports for the new bridge will be completed. If there is to be a support in the median, the foundation for that support will also be built. As the last of the ramp bridges pass, the beams for cross-street bridges may be put in place and the new bridge completed.

Thus, there has been disclosed a novel system for reconstruction of existing heavily traveled highways which uses a set of moving bridges and transition sections. Traffic capacity of the main bridge section is at least as high as the existing roadway and can include three lanes of traffic in both directions. The continuously moving system covers approximately three feet per hour along the length of reconstruction. Traffic moves over this bridge at normal speeds. All phases of construction except building cross-street bridges take place below the main bridge section. Bridges for moving traffic over the construction and constructing the highway in a factory environment are two advantages of the present invention. Thus, with this device, traffic over the device travels at normal speeds on the same number of lanes as the highway being repaired. Also, construction takes place continuously without being broken up into small segments to allow traffic to pass on detours.

While the invention has been described in connection with a preferred embodiment, it is not intended to limit the scope of the invention to the particular form set forth, but, on the contrary, it is intended to cover such alternatives, modifications, and equivalents as may be included within the spirit and scope of the invention as defined by the appended claims.

I claim:

1. A continuously moving reconstruction device for preparing and surfacing a new roadbed from an existing highway without stopping traffic, said device comprising:

a main bridge section carrying all lanes of traffic from the existing highway on one vehicle level, the main bridge section being sufficiently high above the existing highway and in such length and width as to enable preparation and surfacing of the new roadbed;

means associated with the main bridge section for preparing and surfacing the new roadbed below the main bridge section;

additional traffic lanes on the one vehicle level of the main bridge section for receiving supply vehicles that carry materials for preparing and surfacing the new roadbed without interfering with the existing highway traffic;

ramp means associated with each end of the main bridge section for carrying all highway traffic up to and down from the main bridge section; and power means coupled to the main bridge section and the ramp means for supporting and continuously propelling the repair and reconstruction device while the new roadbed is simultaneously prepared and surfaced beneath the main bridge section.

2. A device as in claim 1 wherein the power means comprises:

a plurality of spaced foot pads on each side of the main bridge section;

at least first and second extensible struts pivotally coupled to each foot pad and the main bridge section for moving each foot pad vertically and longitudinally with respect to the main bridge section;

power generating means on the main bridge section coupled to each extensible strut for supplying power to and removing power from the struts; and computer means on the main bridge for generating signals controlling the power generating means such that the foot pads are moved vertically and longitudinally in proper sequence to enable the main body section and the attached ramp means to move continuously along the roadway.

3. A device as in claim 2 further comprising a plurality of rotatable wheels mounted to the ramp means associated with each end of the main body section to enable the ramp means to move with the main bridge section and to distribute high loads on pavement not able to stand concentrated loads.

4. A device as in claim 3 further comprising a third extensible strut coupled between the main bridge section and each foot pad to enable each foot pad to move transversely with respect to the main bridge section to position each foot pad at variable distances away from the main bridge section to accommodate roadway repair beneath the main bridge section.

5. A device as in claim 1 wherein the power means comprises:

a plurality of power driven endless track crawlers on each side of the main bridge section to move the main bridge section continuously along the roadway; and at least one extensible strut pivotally coupled to the main bridge section and each crawler for adjusting each crawler in the vertical plane with respect to the main bridge section to compensate for terrain height variations while keeping the main bridge section at a predetermined angle with respect to the horizontal.

6. A device as in claim 5 further including a second extensible strut pivotally coupled between each crawler and the main bridge section for moving each crawler transversely with respect to the main bridge section to position each crawler at variable distances away from the main bridge section to accommodate roadway repair beneath the main bridge section.

7. A device as in claim 1 further comprising:

additional levels on the main bridge section;

means on the one vehicle level for carrying materials received from the supply vehicles to the area below the main bridge section for surfacing the new roadbed; and means for carrying excavation materials from below the main body section to a level above the one vehicle level for loading the supply vehicles.

8. A device as in claim 1 further including:

means on the device for preparing soil on each side of the roadway; and means on the device for forming side walls of concrete on the prepared soil on at least one side of the roadway.

9. A system for continuously constructing a roadway from an existing highway while simultaneously permitting a continuous flow of traffic, the system comprising:

a continuously moving main bridge section having one level for carrying all lanes of traffic from the existing highway, the main bridge section being sufficiently high above the existing highway and in such length and width as to enable reconstruction of the new roadway under the main bridge section;

means associated with the main bridge section for constructing the roadway below the main bridge section;

additional traffic lanes on the one level of the main bridge section for receiving supply vehicles that carry materials for constructing the roadway;

ramp means coupled ahead and behind the main bridge section for carrying all existing highway traffic up to and down from the main bridge section;

power means coupled to the main bridge section and the ramp means for supporting and continuously propelling the main bridge section and ramp means while the roadway is simultaneously under construction; and movable cross-street bridges positioned before and after the ramp means to enable temporary cross-street traffic to occur while new cross streets are being constructed.

10. A system for continuously constructing a new roadway from an existing highway while simultaneously permitting a continuous flow of traffic on the existing highway, the system comprising:

a continuously moving reconstruction device including a main bridge section and ramp means coupled thereto for enabling the flow of all lanes of traffic from the existing highway over at least one traffic level on the device, the device being sufficiently high above the existing highway and in such length and width as to enable reconstruction of the new roadway beneath the device;

means associated with the device for reconstructing the roadway below the device;

movable cross-street detour bridges placed before and after the device to enable temporary cross-street traffic to occur where old cross-street bridges have been removed and new cross streets are being constructed; and power means coupled to the main bridge section and the ramp means for supporting and continuously propelling the repair and reconstruction device while the new roadbed is simultaneously prepared and surfaced.

11. A system as in claim 10 wherein the continuously moving reconstruction device comprises:

said main bridge section carrying all lanes of traffic from the existing highway on one traffic level, the main bridge section being sufficiently high above the existing highway and in such length and width as to enable preparation and surfacing of the new roadbed beneath the main bridge section;

means associated with the main bridge section for removing the existing highway and preparing and surfacing the new roadbed beneath the main bridge section;

additional traffic lanes on the one traffic level of the main bridge section for receiving supply vehicles that carry materials for preparing and surfacing the new roadbed; and said ramp means associated with each end of the main bridge section for carrying all roadway traffic up to and down from the main bridge section.

12. A system as in claim 11 wherein the power means comprises:

a plurality of spaced rectangular flat pads on each side of the main bridge section;

at least first and second hydraulically operated pistons pivotally coupled to each flat pad and the main bridge section for moving each flat pad vertically and longitudinally with respect to the main bridge section;

hydraulic pressure generating means on the main bridge section coupled to each hydraulic cylinder for supplying pressure to and removing pressure from the hydraulic pistons; and computer means on the main bridge section for generating signals control pressure generating means such that the flat pads are moved vertically and longitudinally in proper sequence to enable the main bridge section and the attached ramp means to move continuously along the roadway.

13. A system as in claim 12 further comprising a plurality of rotatable wheels mounted to the ramp means associated with each end of the main bridge section to enable the ramp means to move with the main bridge section.

14. A device as in claim 13 further comprising a third hydraulic piston coupled between the main bridge section and each flat pad to enable each flat pad to move transversely with respect to the main bridge section to position each pad at variable distances away from the main bridge section to accommodate roadway repairs beneath the main bridge section.

15. A system as in claim 10 wherein the power means comprises:

a plurality of power driven endless track crawlers on each side of the main bridge section to move the main bridge section continuously along the roadway; and at least one hydraulic cylinder pivotally coupled to the main bridge section and each crawler for adjusting each crawler in the vertical plane with respect to the main bridge section to compensate for terrain height variations while keeping the main bridge section substantially level.

16. A system as in claim 15 further including a second hydraulic cylinder pivotally coupled between each crawler and the main bridge section for moving each crawler transversely with respect to the main bridge section to position each crawler at variable distances away from the main bridge section to accommodate roadway repair beneath the main bridge section.

17. A system as in claim 10 further comprising:

additional levels on the main bridge section;

means below the one traffic level for carrying materials from the supply vehicles to the area below the main bridge section for surfacing the new roadbed; and means for carrying excavation materials from below the main bridge section to a level above the one traffic level for loading the supply vehicles on the one traffic level.

18. A system as in claim 10 further including:

means on the device for preparing soil on each side of the roadway; and means on the device for forming side walls of concrete on the prepared soil on at least one side of the roadway.

19. A system as in claim 10 wherein one of said cross-street detour bridges comprises:

a main crossover section extending across the existing highway ahead of the device where one of the old cross-street bridges has been removed to enable temporary cross-street traffic to occur in one direction;

ramps extending from a frontage road on each side of the existing highway and attached to the main crossover section to enable one-way traffic from the frontage road on one side of the existing highway to cross the existing highway to the frontage road on the other side of the existing highway; and power means coupled to the movable cross-street detour bridge and ramps to move the crossover section and the ramps attached thereto along the existing highway ahead of the continuously moving construction device.

20. A system as in claim 19 wherein the power means includes:

a plurality of spaced of the crossover section;

at least first and second extensible struts pivotally coupled to each foot pad and the crossover section for moving each foot pad vertically and longitudinally with respect to the main crossover section;

means on the crossover section coupled to each strut for supplying power to extend and retract the struts; and computer means on the crossover bridge for generating signals controlling the power supplying means such that the foot pads are moved vertically and longitudinally in proper sequence to enable the crossover bridge and the attached ramps to move along the roadway from one position to another.

21. A system as in claim 19 wherein another of the cross-street detour bridges comprises:

a second movable crossover section extending across the newly constructed roadway behind the construction device where new crossover bridges have been constructed but are not temporarily usable to enable temporary cross-street traffic to occur in the other direction, the ends of the movable crossover section mating with the frontage roads; and power means coupled to the second movable crossover section for propelling the second crossover section.

22. A system as in claim 21 wherein the power means for each of the cross-street detour bridges comprises:

a plurality of spaced rectangular flat pads associated on each side of the movable crossover section;

at least first and second hydraulically operated pistons pivotally coupled to each flat pad and the respective movable crossover section for moving each flat pad vertically and longitudinally with respect to the crossover section;

hydraulic pressure generating means on the respective crossover section coupled to each hydraulic piston for supplying pressure to and recovering pressure from the hydraulic pistons; and computer means on the respective crossover section for generating signals controlling the hydraulic pressure generating means such that the flat pads are moved vertically and longitudinally in sequence to enable the crossover section and any attached ramps to move along the existing highway and the newly constructed roadway.

23. A system as in claim 22 further comprising a third hydraulic piston coupled between the respective crossover section and each associated flat pad to enable each flat pad to move transversely with respect to the crossover bridge section to position each pad at variable distances away from its associated crossover section to accommodate roadway conditions beneath the main crossover bridge section.

* * * * *

UNITED STATES PATENT AND TRADEMARK OFFICE

CERTIFICATE OF CORRECTION

PATENT NO. : 5,105,494

DATED : April 21, 1992

INVENTOR(S) : D. Cameron Ogg

It is certified that error appears in the above-identified patent and that said Letters Patent is hereby corrected as shown below:

Column 3, Line 33, after "3F-3K" and before "the", delete "show" and insert --illustrate how--.

Column 6, Line 43, "quelling" should read --queuing--.

Column 13, Line 55, after "hydraulic", delete "cylinder" and insert --piston--.

Column 13, Line 59, after "signals" and before "pressure" delete "control" and insert --controlling the hydraulic--.

Column 14, Line 30, after "from" and before "supply" delete "the".

Column 14, Line 64 after "spaced" and before "of", insert --footpads on each side--.

Signed and Sealed this

Thirty-first Day of August, 1993

Bruce Lehman

*Attest:*

BRUCE LEHMAN

*Attesting Officer*

*Commissioner of Patents and Trademarks*